United States Patent [19]

Kumano

[11] 4,414,718

[45] Nov. 15, 1983

[54] SEPARABLE SLIDE FASTENER

[75] Inventor: Isamu Kumano, Kurobe, Japan

[73] Assignee: Yoshida Kogyo K. K., Tokyo, Japan

[21] Appl. No.: 374,318

[22] Filed: May 3, 1982

[30] Foreign Application Priority Data

May 7, 1981 [JP] Japan ..... 56-65137[U]

[51] Int. Cl.[3] ..... A44B 19/00

[52] U.S. Cl. ..... 24/396; 24/434

[58] Field of Search ..... 24/205 R, 205 G, 205.1 R, 24/205.11 R, 205.11 F, 205.12, 205.13, 205.13 D, 205.14 R

[56] References Cited

U.S. PATENT DOCUMENTS 3,046,627 7/1962 Morin ..... 24/205.1 R
3,333,305 8/1967 Taylor ..... 24/205.11 F

FOREIGN PATENT DOCUMENTS 259593 1/1964 Australia ..... 24/205.11 F
2431924 1/1976 Fed. Rep. of Germany ... 24/205.11 F
463177 11/1968 Switzerland ..... 24/205.11 F

*Primary Examiner*—Gene Mancene
*Assistant Examiner*—James R. Hakomaki
*Attorney, Agent, or Firm*—Hill, Van Santen, Steadman & Simpson

[57] ABSTRACT

A separable slide fastener comprises a pair of stringer tapes, a pair of rows of continuous coupling elements of thermoplastic synthetic resin sewn to the tapes, along respective inner longitudinal edges, and a separable terminal assembly located at a lower end of the coupling element rows. Connectors of the endmost ones of the coupling elements located adjacent to pins of the terminal assembly are fused with the respective stringer tapes, the pins each having a pair of opposite plates disposed one on each side of the respective stringer tapes. In order to prevent the displacement of the endmost coupling elements, one of the plates extends beyond the other plate to overlie each said fused endmost connector, the other plate terminating short of the fused endmost connector.

4 Claims, 4 Drawing Figures

PRIOR PROBLEM

SEPARABLE SLIDE FASTENER

BACKGROUND OF THE INVENTION

1. Field of the Invention

The present invention relates to a slide fastener and more particularly to a separable type of slide fastener having a separable terminal assembly.

2. Prior Art

There have been proposed a number of separable slide fasteners with a separable terminal assembly which is located at a lower end of a pair of rows of filamentary coiled or zigzag coupling elements of thermoplastic synthetic resin sewn to a pair of stringer tapes, respectively, along inner longitudinal edges thereof with a reinforcing core thread extending through each of the coupling element rows. The terminal assembly comprises a box and a box pin extending therefrom, which are mounted on one of the stringer tapes at a lower end thereof, and a separable pin mounted on the other stringer tape at a lower end thereof and engageable with the box, each pin having a pair of spaced upper and lower plates. For mounting the terminal assembly, connecting portions of the lowermost coupling elements are fused to the respective stringer tapes. Then, the box pin and the separable pin are placed on the lower ends of the tapes astride the respective inner longitudinal edges and extensions of the reinforcing core threads and sewing stitches are laid over the lower ends of the tapes. Thereafter, the box and box pin and the separable pin are secured, by a clinching tool, to the respective lower ends of the tapes with the top edges of the pins held in abutting engagement with legs of the lowermost coupling elements. Since the upper and lower plates of each pin have the same length, they, as secured to the tape ends, are arranged in superposed relation to one of the fused lowermost connecting portions. With this arrangement, stresses are created as the upper and lower plates are pressed toward one another, which stresses tend to squeeze the core threads, sewing stitches and the tape ends out from the pins, with the result that the lowermost coupling elements are displaced in a direction away from the fused connecting portions toward adjacent ones of the coupling elements. The displaced lowermost coupling elements hinder smooth movement of the slider, when a slider moves toward and away from the separable terminal assembly to open and close the fastener. In some instances, the slider is blocked at a position just before the separable terminal assembly. The starting movement of the slider in the fastener closing direction is also liable to become sluggish, sometimes even impossible.

SUMMARY OF THE INVENTION

It is therefore an object of the invention to provide an improved separable slide fastener which will eliminate the above-noted difficulties of the prior art devices.

A more specific object of the invention is to provide a separable slide fastener wherein a slider is allowed to move smoothly toward and away from a separable terminal assembly.

According to the present invention, a separable slide fastener comprises a pair of stringer tapes, a pair of rows of continuous coupling elements of thermoplastic synthetic resin sewn to the tapes, along respective inner longitudinal edges, and a separable terminal assembly located at a lower end of the coupling element rows. Connectors of the endmost ones of the coupling elements located adjacent to pins of the terminal assembly are fused with the respective stringer tapes, the pins each having a pair of opposite plates disposed one on each side of the respective stringer tapes. One of the plates extends beyond the other plate to overlie each said fused endmost connector, the other plate terminating short of the fused endmost connector, whereby the endmost coupling elements are prevented from being displaced in a direction away from the fused endmost connectors toward adjacent ones of the coupling elements when the terminal assembly is secured to the tape ends.

Many other advantages, features and additional objects of the present invention will become manifest to those versed in the art upon making reference to the detailed description and the accompanying drawings in which a preferred embodiment incorporating the principles of the present invention is shown by way of illustrative example.

DETAILED DESCRIPTION

Figure 5:
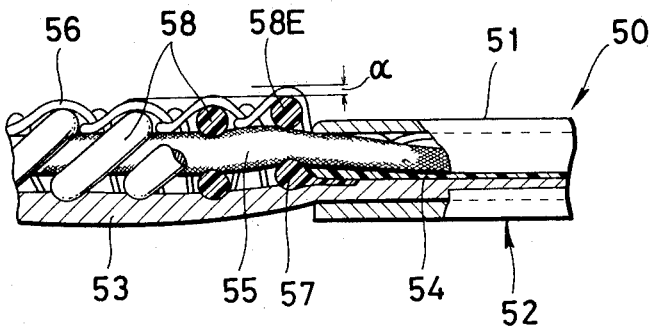
FIG. 5 is a fragmentary cross-sectional view similar to FIG. 4, but showing a conventional arrangement.

As shown in FIG. 5, a separable pin 50 of a conventional separable terminal assembly has a pair of flanged upper and lower plates 51,52 between which the lower end of a stringer tape 53 with a reinforcing film 54 disposed thereon, a core thread 55 and a sewing stitches 56 are gripped. The plates 51,52 have the same length and are held in superposed relation to a fused connector 57 of the endmost one (58E) of a row of coiled coupling elements 58 sewn to the stringer tape 53. Due to stresses created during clinching of the separable pin 50, the sewing stitches 56, the core thread 55 and the reinforced tape end portion have been squeezed out from the separable pin 50. The endmost coupling element 58E is therefore displaced upwardly beyond the upper level of the succeeding elements 58 by a distance $\alpha$ toward the adjacent one or the second lowermost coupling element. The displaced endmost coupling element 58E hinders smooth sliding movement of a slider (not shown) toward and away from the separable terminal assembly.

The present invention is described with reference to FIGS. 1 through 4.

Figure 1:
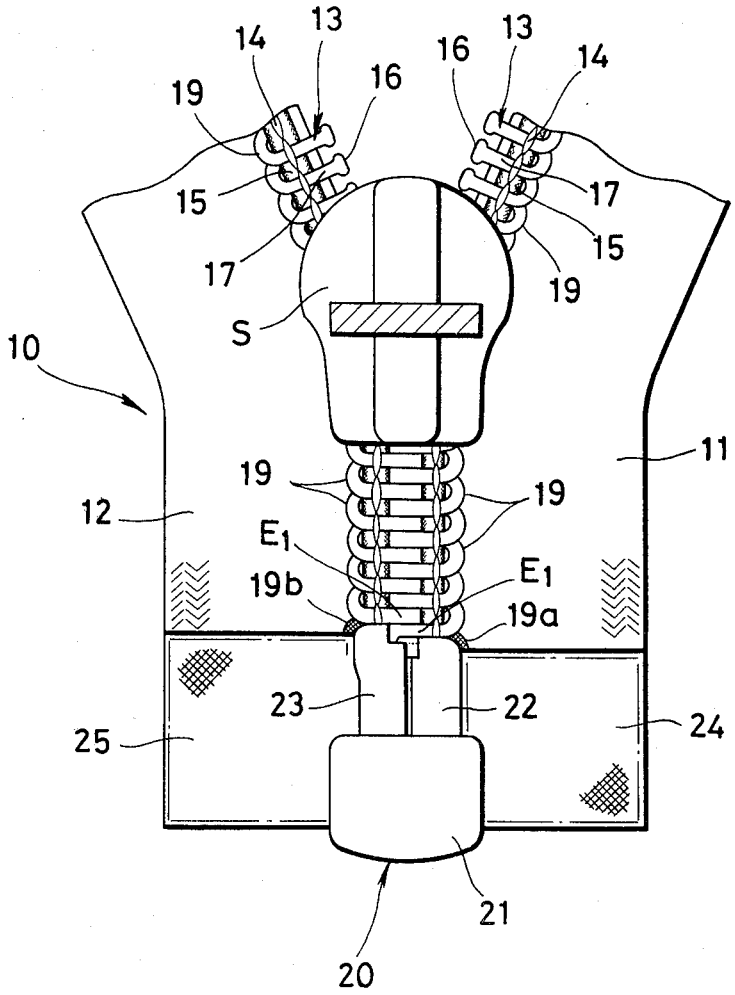
FIG. 1 is a fragmentary plan view of a separable slide fastener embodying the present invention.
Figure 4:
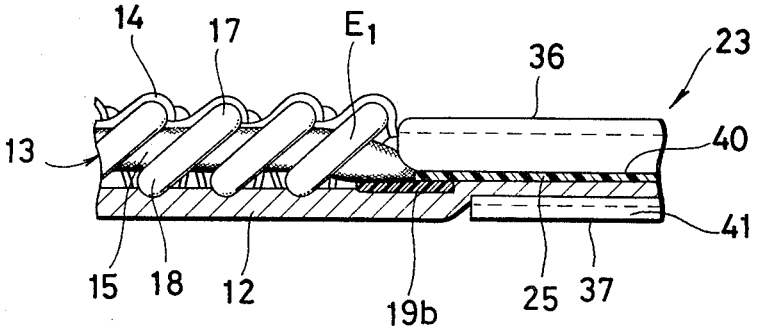
FIG. 4 is a cross-sectional view taken along the line IV—IV of FIG. 3.

As shown in FIG. 1, a separable slide fastener 10 comprises a pair of stringer tapes 11,12 each carrying on and along its one longitudinal edge a row of coupling elements 13 in the form of a continuous filamentary coil made of a thermoplastic synthetic resin such as nylon, polyester or the like. Each row of coupling elements 13 is secured to the tape 11,12 by means of sewing stitches 14 with a reinforcing core thread or stuffer warp 15 extending longitudinally through the coiled coupled element row 13. Each of the coupling elements 13 has a coupling head 16, a pair of spaced upper and lower legs 17,18 (the lower leg being shown in FIG. 4) extending from the coupling head 16 in a common direction, and a connector 19 extending from the lower leg 18 to the upper leg 17 of an adjacent one of the coupling elements, the lower leg 18 lying on one surface, namely the upper surface of the stringer tape 11,12. A separable terminal assembly 20 is mounted on the lower ends of the stringer tapes 11,12 at the lower ends of the rows of coupling elements 13, and includes a box 21 and a box pin 22 extending therefrom, the box 21 and the box pin 22 being secured by clinching to the lower end of the stringer tape 11 along the longitudinal edge thereof, and a separable pin 23 secured by clinching to the lower end of the stringer tape 12 along the longitudinal edge thereof and engageable with the box 21. The connectors 19*a*,19*b* of the endmost coupling elements $E_1$,$E_1$ located adjacent to the pins 22,23 are fused with the respective stinger tapes 11,12. A pair of reinforcing films 24,25 of thermoplastic synthetic resin is mounted on the upper surfaces of the stringer tapes 11,12, respectively, at the lower ends thereof, each of the films 24,25 overlapping one of the fused connectors 19*a*,19*b* as best shown in FIG. 4. A slider S is slidably mounted on the coupling element rows 13,13 to take them into and out of interdigitating engagement with each other for closing and opening the separable slide fastener 10.

Figure 2:
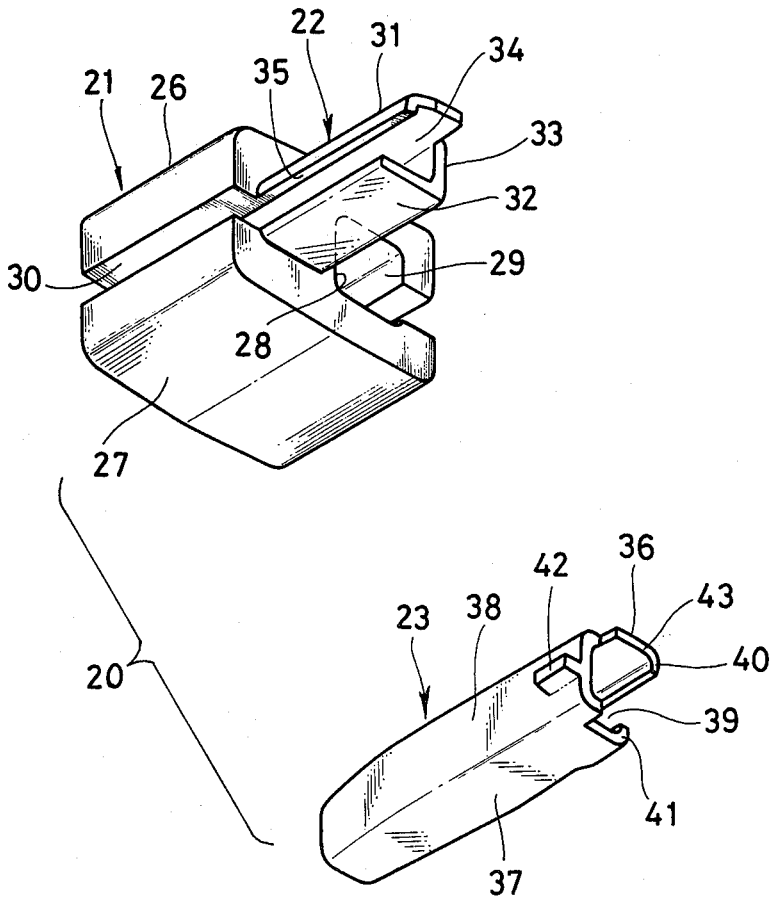
FIG. 2 is an enlarged exploded perspective view of a separable bottom end stop of the separable slide fastener shown in FIG. 1.

As shown in FIG. 2, the box 21 and the box pin 22 of the separable terminal assembly 20 are formed integrally with each other. The box 21 includes a pair of flanged upper and lower wings 26,27 joined by a partition wall 28 extending centrally longitudinally of the wings 26,27 to form a pair of longitudinal grooves 29,30, one 29 for receiving the separable pin 23, and the other 30 for receiving the longitudinal edge of the stringer tape 11, the reinforcing film 24, the core thread 15 and the sewing stitches 14 that are located at the lower end of the stringer tape 11. The box pin 22 extends from the upper end of the box 21 and has a pair of upper and lower plates 31,32 interconnected at one edge by a sidewall 33 to define therebetween a longitudinal groove 34 which communicates with, and has substantially the same contour as, the groove 30 in the box 21 for the same purpose as the groove 30. The lower plate 32 and the sidewall 33 are cut off or notched at the respective top ends so that the upper plate 31 extends beyond the top ends of the lower plate 32 and the sidewall 33 by a distance slightly larger than the extent of the fused endmost connector 19*a*. The upper plate 31 has at the other edge a longitudinal flange 35 projecting therefrom toward the lower plate 32.

The separable pin 23 is of generally C-shaped cross section and has a pair of upper and lower plates 36,37 interconnected at one edges by a sidewall 38 to define therebetween a longitudinal groove 39 for receiving therein the longitudinal edge of the stringer tape 12, the reinforcing film 25, the core thread 15 and the sewing stitches 14 that are located at the lower end of the stringer tape 12. The upper and lower plates 36,37 have, at the respective other edges, a pair of longitudinal flanges 40,41, extending toward one another. The sidewall 38 is cut off or notched at the top end thereof and the lower plate 37 is also cut off or notched at the top end so that the sidewall 38 extends beyond the top end of the lower plate 37, and the upper plate 36 extends beyond the top end of the lower plate 37 by a distance larger than the extent of the fused endmost connector 19*b*. The sidewall 38 has a lateral projection 42 adjacent to the top end thereof for projecting into the notched portion of the sidewall 33 of the box pin 22 to thereby hold the pins 22,23 in a proper position shown in FIGS. 1 and 3 when the separable pin 23 is received in the groove 29 in the box 20.

Prior to the attachment of the separable terminal assembly 20 to the lower ends of the stringer tapes 11,12, those coupling elements which are located at the lower ends of the stringer tapes 11,12 are cut at the respective connectors and removed from the stringer tapes 11,12 through loops of the sewing stitches 14,14. Then, the connectors 19*a*,19*b* of the endmost remaining coupling elements $E_1$,$E_1$ are fused with the respective upper surfaces of the stringer tapes 11,12, in response to heat and pressure applied by a suitable ultrasonic welding or high-frequency heating means (not shown). Thereafter, the reinforcing films 24,25 of thermoplastic synthetic resin are placed on the respective stringer tapes 11,12 at the lower ends thereof and then are fused with the tapes 11,12 in the same manner as the endmost connectors 19*a*,19*b* for reinforcing the lower ends of the tape.

Figure 3:
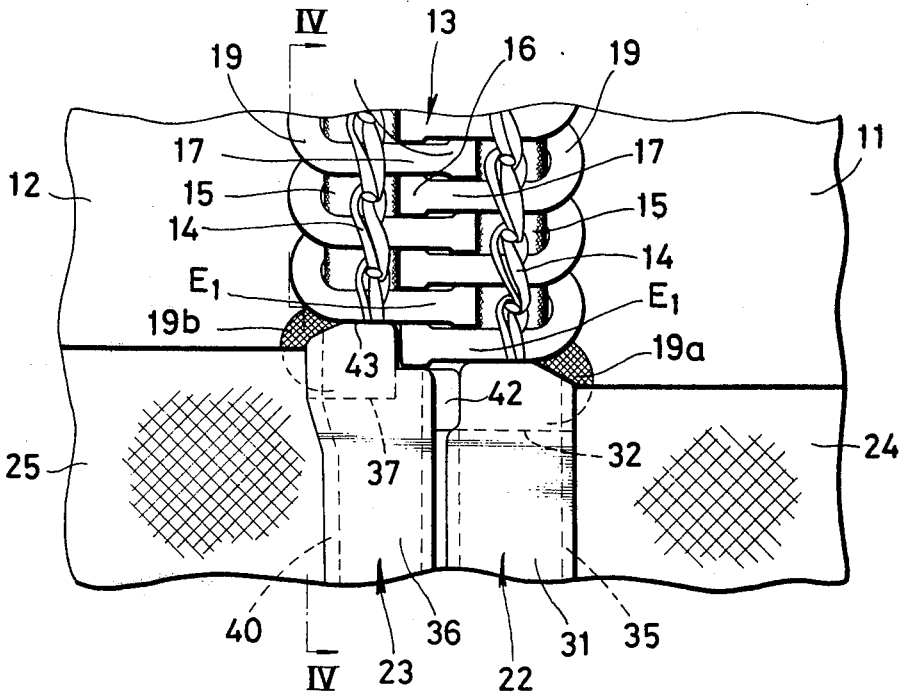
FIG. 3 is an enlarged plan view of a portion of FIG. 1.

The separable pin 23 is placed on the lower end of the reinforced tape astride the inner longitudinal edge thereof with extensions of the sewing stitches 14 and the core thread 15 received in the groove 39. In this instance, the top end 43 of the upper plate 36 is held substantially in abutting engagement with the upper leg 17 of the endmost coupling element $E_1$ with a loop of the sewing stitches interposed therebetween. On the other hand, the top end of the lower plate 37 terminates short of the fused endmost connector 19*b*. Then the upper and lower plates 36,37 of the separable pin 23 are pressed toward each other by a suitable clinching tool (not shown) thereby positively gripping the tape's lower end between the respective flanges 40,41, as shown in FIGS. 3 and 4. During that time, the endmost coupling element $E_1$ is prevented from displacing in any direction, in particular upwardly away from the fused connector 19*b* toward the adjacent coupling element because the lower plate 37 is held out of underlying relation to the fused connector 19*b*. Stresses tending to squeeze the tape 12, the core thread 15, and the sewing stitches 14 out from the groove 39 in the pin 23, are substantially of negligible order and hence have no influence on the displacement of the endmost coupling element $E_1$.

The attachment of the box 21 and the box pin 22 to the tape's lower end is accomplished in the same manner as the retainer pin 23. The slider S can move smoothly over the endmost coupling elements $E_1$,$E_1$ toward and away from the terminal assembly 20 to open and close the separable slider fastener 10.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A separable slide fastener, comprising:

(a) a pair of stringer tapes each carrying on its one longitudinal edge a row of continuous coupling elements of thermoplastic synthetic resin, each said coupling element having a coupling head, a pair of spaced legs extending from said coupling head in a common direction, and a connector extending from one of said legs to one leg of an adjacent coupling element;

(b) sewing stitches securing said rows of coupling elements to the respective stringer tapes; and (c) a separable terminal assembly comprising a box and a box pin extending therefrom mounted on one of said stringer tapes at one end thereof, and a separable pin mounted on the other stringer tape at one end thereof and engageable with said box, (d) said connectors of the endmost coupling elements located adjacent to said pins being fused with the respective stringer tapes, said pins each having a pair of opposite plates disposed one on each side of the respective stringer tapes, one of said plates extending beyond the other plate to overlie each said fused endmost connector, said other plate terminating short of the fused endmost connector.

2. A separable slide fastener according to claim 1, each said one plate being held, at its one end, substantially in abutting engagement with one leg of each of the endmost coupling elements.

3. A separable slide fastener according to claim 1, each said pin further having a sidewall connecting said plates together, said sidewall of said separable pin having a projection and said sidewall of said box pin having a notch for receiving said projection.

4. A separable slide fastener according to claim 1, said rows of continuous coupling elements being respectively mounted on one surface of said stringer tapes, said other plates of each said pin lying on the other surface of the stringer tape.

* * * * *